US006191751B1

(12) United States Patent
Johnson

(10) Patent No.: US 6,191,751 B1
(45) **Date of Patent: *Feb. 20, 2001**

(54) DIRECTIONAL ANTENNA ASSEMBLY FOR VEHICULAR USE

(75) Inventor: Greg Johnson, Aptos, CA (US)

(73) Assignee: RangeStar Wireless, Inc., Aptos, CA (US)

( * ) Notice: Under 35 U.S.C. 154(b), the term of this patent shall be extended for 0 days.

This patent is subject to a terminal disclaimer.

(21) Appl. No.: 09/303,397

(22) Filed: May 1, 1999

Related U.S. Application Data

(60) Provisional application No. 60/083,795, filed on May 1, 1998.

(51) Int. Cl.[7] ..... H01Q 19/10

(52) U.S. Cl. ..... 343/834; 343/713; 343/722; 343/752

(58) Field of Search ..... 343/833, 834, 343/749, 752, 722, 837, 713; H01Q 19/10

(56) References Cited

U.S. PATENT DOCUMENTS

| | | | | |
|---|---|---|---|---|
| 3,725,938 | * | 4/1973 | Black et al. | 343/833 |
| 4,010,475 | * | 3/1977 | James | 343/830 |
| 4,494,122 | * | 1/1985 | Garay et al. | 343/722 |
| 5,767,807 | * | 6/1998 | Pritchett | 343/833 |
| 5,767,812 | * | 6/1998 | Basciano et al. | 343/722 |
| 5,999,140 | * | 12/1999 | Johnson | 343/722 |

* cited by examiner

*Primary Examiner*—Don Wong
*Assistant Examiner*—Hoang Nguyen
(74) *Attorney, Agent, or Firm*—Larkin, Hoffman, Daly & Lindgren, Ltd.; John F. Klos

(57) ABSTRACT

A multi-element radio antenna assembly is described. The antenna assembly includes a ground plane element having an array of conductor elements disposed thereon. A pair of LC trap structures provide dual band resonance for cellular telephone and PCS device bandwidth ranges. Additional performance may be achieved with parasitic reflector and director elements. The multi-element directional antenna finds particular applicability for in-vehicle use.

13 Claims, 2 Drawing Sheets

DIRECTIONAL ANTENNA ASSEMBLY FOR VEHICULAR USE

CROSS REFERENCE TO RELATED APPLICATION

This application claims the benefit of priority pursuant to 35 USC §119(e)(1) from the provisional patent application filed pursuant to 35 USC §111(b): as Ser. No. 60/083,795 on May 1, 1998.

FIELD OF THE INVENTION

This invention relates generally to antenna structures, and in particular to dual band directional antenna assemblies. The invention provides particular utility to dual band antennas for use in vehicular applications.

BACKGROUND OF THE INVENTION

Wireless communication is well known for communicating over large distances and also where the communicating devices require a high degree of mobility. Known antenna devices for use in communication systems are capable of resonating at two or more different frequencies. U.S. Pat. No. 4,494,122 to Garay et al. and U.S. Pat. No. 5,406,296 to Egashira et al. disclose two examples of multiple frequency antenna structures. Also known are antenna structures finding particular applicability within the interior portions of vehicles. U.S. Pat. Nos. 5,634,209 and 5,649,316 both to Prudhomme et al. disclose a radio antenna system that can be positioned in a variety of locations within a vehicle interior.

SUMMARY OF THE INVENTION

An antenna structure exhibiting first and second predetermined resonant frequency ranges is disclosed. The present invention includes a directional antenna assembly for use in the cellular telephone and PCS device frequency ranges (800–900 MHz. and 1850–1990 MHz., respectively). The antenna assembly is adapted for in-vehicular use and may be housed within the rear view mirror assembly, the brake light assembly, or a separate housing and dashboard or rear-deck mounted to provide provides thru-glass access. The improvements and benefits of the antenna assembly of the present invention include:

- An increased signal strength, resulting in extended signal range and fewer dropped calls for a given power consumption rate;
- Reduced radio frequency radiation incident to a vehicle occupant's body, thereby reducing potential health risks;
- Reduction in the physical size of a directional antenna;
- Improved directionality and gain—reduced rearward radio radiation (front-to-back ratio of 1–10 nominal) and forward gain of 2.7 dBi; and
- Reduction in multipath interference, resulting from better call/data quality.

An improved cellular telephone/PCS device antenna assembly is provided for suitable applicability within vehicles. The antenna assembly is attractive, economical, reliable and effective. The inventive antenna assembly is useful in association with many types of vehicles, such as: automobiles, vans, trucks, taxicabs, buses, motorcycles, construction equipment, tractors, and agricultural vehicles.

The cellular telephone and PCS device system has an antenna housing for securing and protecting the antenna components and which may be secured within the vehicle interior. A coaxial cable operatively couples the antenna assembly to the cellular telephone/PCS device.

The antenna structure includes a conductive driven element which is electrically coupled to a feed port of the radio device. An end of the conductive driven element is coupled to a first LC trap structure. The antenna assembly further includes a second LC trap structure aligned relative the driven element and disposed upon a conductive reflector element. A resonant circuit is thus provided and includes the driven element, reflector element, and pair of LC trap structures.

In a preferred form, the cellular telephone/PCS device antenna assembly is positioned within an antenna housing in the interior of a vehicle. A desirable feature of an interior mounted antenna assembly as compared to an exterior mounted antenna is the lack of a vehicle surface aperture for passing the coax feed line to the exterior environment. The antenna assembly also provides a disguised antenna which is hidden to prevent unwanted recognition, making the antenna assembly less visible and accessible to thieves and vandals. Since the antenna assembly is encased in a protective housing, it cannot easily be bent, broke, or otherwise damaged. Advantageously, the in-vehicle antenna assembly is not normally in contact with or adversely effected by external weather conditions, e.g. ice, snow, sleet, or rain.

The antenna assembly is also less obstructive to the occupants of the vehicle and provides a greater unimpaired range of vision for the driver. In one preferred embodiment, the antenna assembly may reside within a separate housing which may be dash-mounted or rear-deck mounted. In another embodiment, the antenna assembly may be positioned within an upper rear brake light assembly of the vehicle. In yet another embodiment, the in-vehicle antenna assembly is positioned within a rear view mirror assembly.

Yet another object of the invention provides an antenna structure partially formed from a metallic stamping. Elements of the antenna structure may be efficiently defined by reshaped regions of a conductive planar panel through a stamping or related process. These and other objects, features and advantages of the present invention will become apparent to one skilled in the art upon analysis of the following detailed description in view of the drawings.

BRIEF DESCRIPTION OF THE DRAWINGS

Yet other objects and advantages of the present invention may be seen from the followed detailed description taken in conjunction with the accompanying drawings wherein like numerals depict like parts throughout, and wherein.

DESCRIPTION OF A PREFERRED EMBODIMENT

Figure 1:
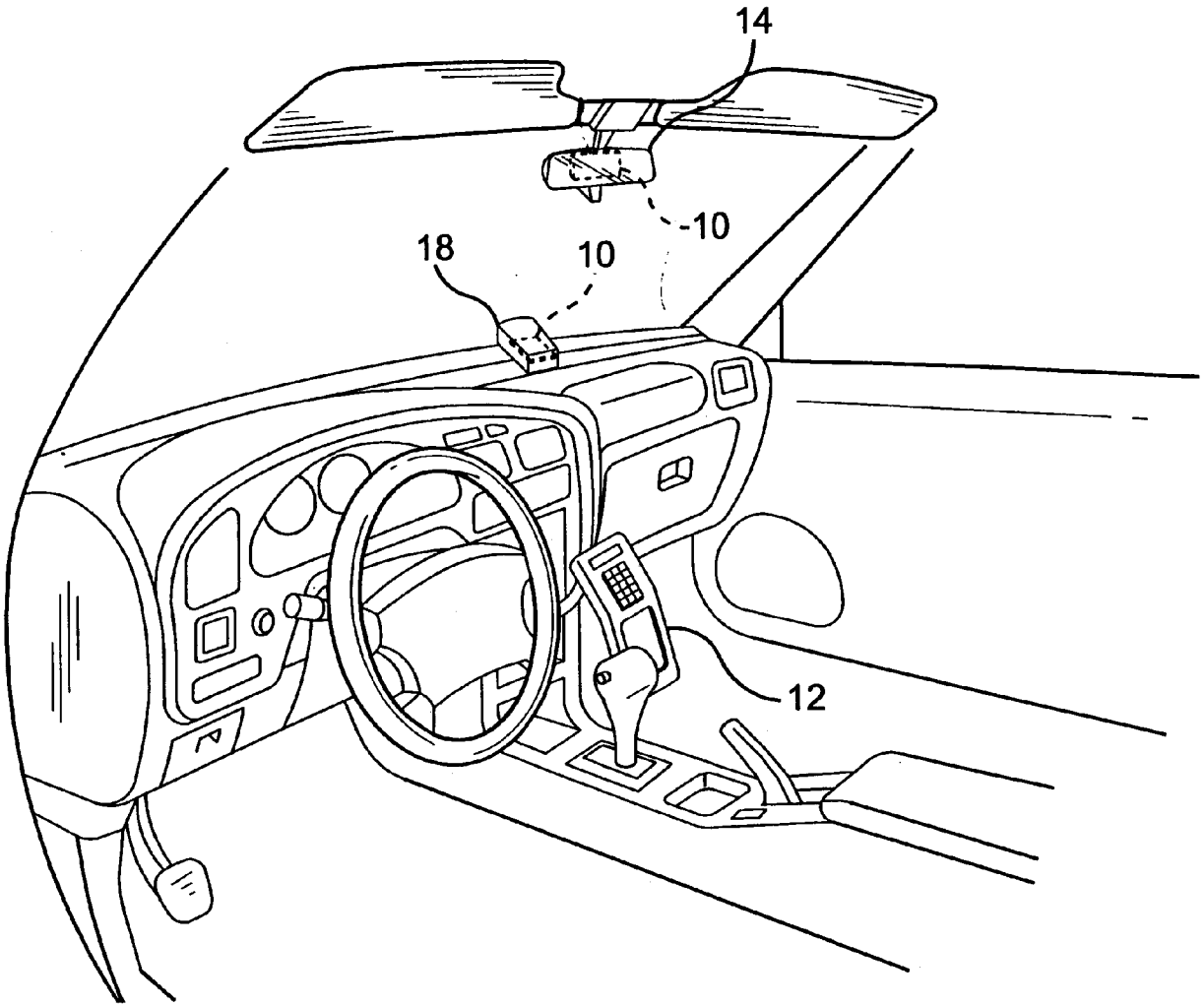
FIG. 1 illustrates a perspective view of an antenna assembly of the present invention in an vehicular application.

An antenna assembly 10 for a multiple-band radio frequency transceiver such as a cellular telephone and PCS communication device 12 is disclosed. With reference to FIG. 1, the antenna assembly 10 of the present invention may be mounted within the rear view mirror assembly 14, a rear upper brake light assembly, or within a separate housing 18 secured within the interior of the vehicle. A dash-mounted housing 18 may be secured with suction cups or with other known approaches. The invention provides a directional antenna assembly 10 having a dual-band driven element 20 provided in a substantially perpendicular relationship to a conductive ground plane member 22. Additional features of the antenna assembly 10 include a director element 24, an impedance matching stub element 26, and reflector elements 28, 30.

The inventive antenna assembly 10 shown in the figures and disclosed herein is especially suitable for in-vehicle use, particularly for an automobile. It is to be understood that the inventive antenna assembly 10 can be used with other types of vehicles, such as: vans, trucks, buses, motorcycles, construction equipment, or tractors and other agricultural vehicles. It should be further appreciated that the antenna assembly 10 may find additional applicability to non-vehicular applications. As disclosed herein, the antenna assembly 10 is secured within an antenna housing 18 which is preferably entirely contained within the interior of the vehicle. The dashboard mounted antenna housing 18 may be positioned generally along the vehicle centerline.

Figure 2:
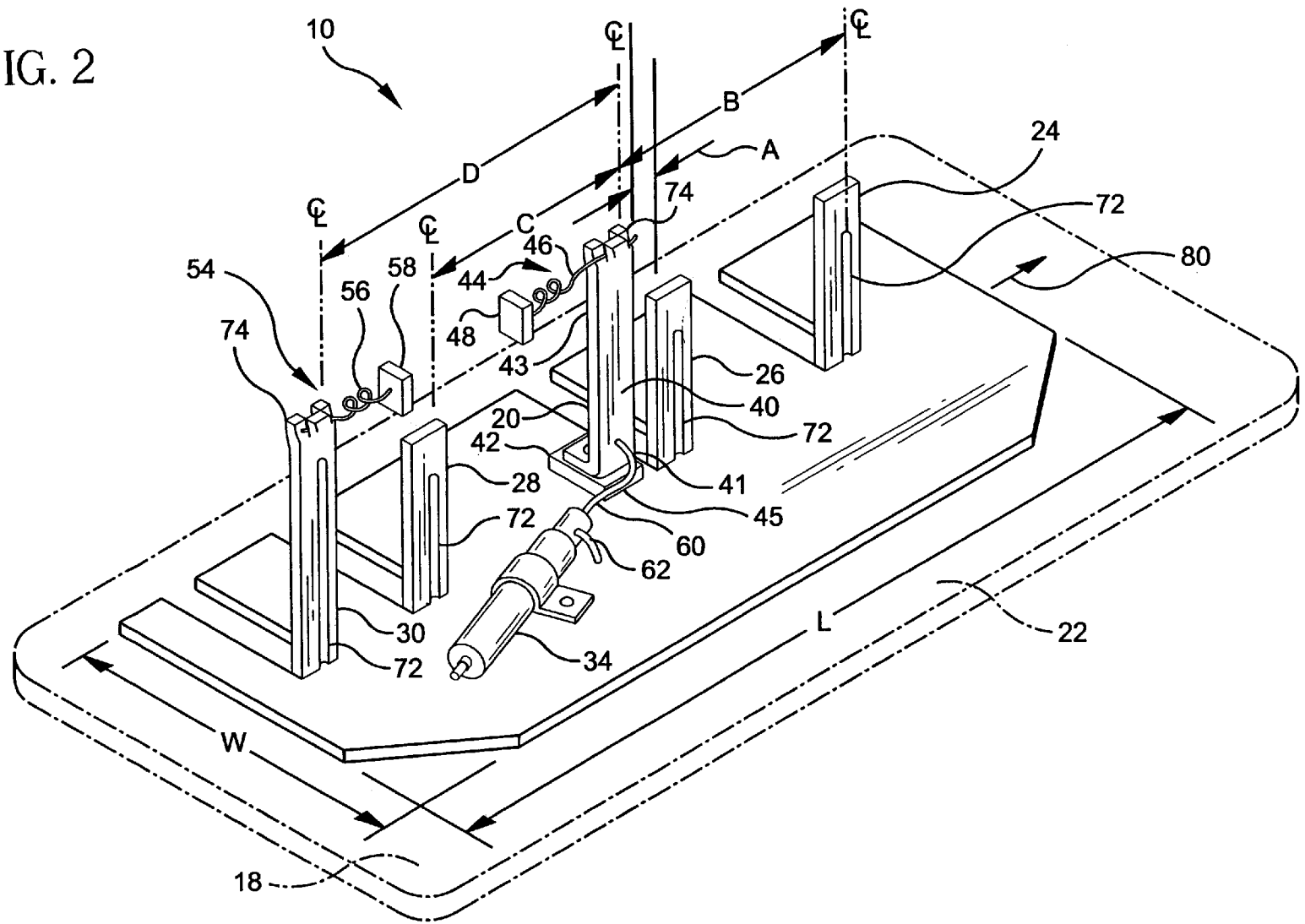
FIG. 2 illustrates a perspective view of a portion of the antenna assembly of FIG. 1.

Referring now to FIG. 2, the in-vehicle dual-band antenna assembly 10 of the present invention includes a dual-band driven element 20, parasitic reflector elements 28, 30, a director element 24, and an impedance matching stub element 26. Each element 20, 24, 26, 28, 30 is substantially planar in form and the elements together are substantially coplanar (in the general direction of maximum gain 80). Furthermore, all elements 20, 24, 26, 28, 30 are substantially perpendicularly aligned relative to the conductive ground plane 22. All elements 20, 24, 26, 28, 30 are conductive elements. In a preferred embodiment, the vertical array elements 24, 26, 28, 30 are extensions of the conductive ground plane member 22. A metal stamping or similar metal forming process may be used to form the elements 22, 24, 26, 28, 30 from an integral planar conductive sheet.

Referring still to FIG. 2, the dual-band driven element 20 of the antenna assembly 10 includes a panel portion 40 having a first end 41 and second end 43. The dual band driven element 20 is supported at the first end 41 of the panel portion 40 upon a dielectric spacer member 42 having a dielectric constant in the range of 1–10. Dual band driven element 20 is maintained upon dielectric spacer member 42 in operative isolation from the ground plane element 22. Dielectric spacer member 42 may be formed as an extension or platform of housing 18 which passes through a rectangular aperture 43 of the ground plane member 22. Conductive panel portion 40 has a height of 1.79 in (+/−0.1 in. tolerance) (height herein defined in the direction perpendicular to the conductive ground plane element 22). Disposed at the second end 43 of the panel portion 40 is an LC (Inductor-Capacitance) trap structure 44 formed of a conductive coil 46 and a conductive resonance panel 48. The function of the LC trap 44 is to create a high impedance block above a resonant frequency to impede higher frequency signals, while permitting the passage of lower frequency signals. In the illustrated embodiment, the LC trap structure 44 chokes the PCS frequency range (1850–1990 MHz.) while permitting resonance panel 48 to resonate at the 800–900 MHz. frequency range. The resonance panel 48, which is also generally planar in form (though perpendicular to the element 20) is sized to resonant over the 800–900 MHz frequency range. The area of the resonance panel 48 is approximately 0.2 in. squared, with an preferred size range of between 0.1 in. squared and 0.6 in. squared. It is appreciated that the resonance panel 48 can be disposed in relation to the element 20 of the antenna 10 through a variety of support structures (not shown).

Disposed away from the dual band driven element 20 in the general direction of maximum signal propagation 80 is an optional impedance matching stub element 26. The height of the stub element 26 is 1.15 inch, with a tolerance of performance of +/−0.1 in. The edge-to-edge distance, A, between the dual band driven element 20 and the stub element 26 is 0.03 in., with a functional range between 0.01 in. and 0.4 in. Still further away from the dual band driven element 20 and in the general direction of maximum signal propagation is the high-frequency director element 24. The height of the director element 24 is 1.7 in., with a tolerance of performance of +/−0.1 in. The center-to-center distance, B, between the dual band driven element 20 and the director element 24 is 0.8 in., with a functional range between 0.7 inch and 1.2 inch.

Disposed away from the dual band driven element 20 and in the direction away from the maximum signal propagation 80 is a high-frequency reflector element 28. The reflector element 28 has a height of 1.48 in., with a tolerance of performance of +/−1.0 inch. The center-to-center distance, C, between the dual band driven element 20 and the reflector element 28 is selected within a functional range between 0.9 inch and 1.9 inch. Disposed further away from the dual band driven element 20 and in the direction away from the maximum signal propagation 80 is a low frequency reflector element 30. The low frequency reflector element 30 has a height of 1.79 in., with a tolerance of performance of +/−0.1 inch. The center-to-center distance, D, between the dual band driven element 20 and the LF reflector element 30 is selected within the functional range between 1.2 inch and 2.4 inch. Attached at an end of LF reflector element 30 is an LC trap structure 54 similar to trap structure 44, and having a conductive coil 56 and a resonant panel 58. The area of the resonant panel 58 is approximately 0.2 in. squared, with a preferred size range of between 0.1 in. squared and 0.6 in. square.

The LC trap structures 44, 54 of the antenna assembly 10 each include an inductive loop 46, 56 (an axis of the loops 46, 56 being substantially parallel with the direction of maximum signal propagation 80). Each loop 46,56 is formed of a conductive wire having a thickness of 0.03 in. nominal and is shaped with loops having a 0.18 in. nominal inside diameter. Each loop 46, 56 is formed with approximately 3.5 wire turns. The nominal overall length of each loop 46, 56 is 0.28 inch. One end of each loop 46, 56 is attached to respective conductive elements 20, 30 by a mechanical crimp 74 defined at an upper portion of the elements 20, 30. Resonance panels 48, 58 are parallely aligned and perpendicular to planes containing vertical array elements 22, 24, 26, 28, 30 or ground plane member 22. Those skilled in the art will appreciate that the LC traps structures 46, 56 function as an RF choke at the high band frequencies and permit resonance in conjunction with resonant panels 48, 58 at the low band frequencies.

Center conductor 60 of the coaxial cable feed line 34 is coupled to the first end 41 of the dual band driven element 40. The shield 62 of the coax feed line 34 is coupled to the ground plane element 22. Importantly, no additional ferrite shielding element (balun) surrounding the coax cable 34 for suppressing radio frequency currents from the outer shield 62 of the coax cable 34 is required.

The widths of the elements 20, 24, 26, 28, 30 are approximately 0.15 in. and may be selected from within a range of between 0.03 in. and 0.3 in. A preferred technique of manufacturing the antenna assembly 10 includes a die-stamp or other punch-type metal forming operation which defines and forms the individual elements 24, 26, 28, 30 from the conductive ground plane member 22. Vertical array elements 20, 24, 26, 28, 30 may include vertical ribs or gussets 72 extending along their length to improve element rigidity.

The ground plane member 22 has a thickness of 0.62 in. The thickness may be selected from within the range from 0.001 to 0.5 in. The overall dimensions L, W of the ground plane element 22 are approximately 0.35λ and 0.25λ respectively (λ of the lowest frequency of operation). Alternative manufacturing approaches may included brazing or soldering operations to secure the individual elements 20, 24, 26, 28, 30 relative to the ground plane 22. It is not a requirement that the individual elements 20, 24, 26, 28, 30 and the ground plane member 22 be of the same conductive material.

It is understood that even though numerous characteristics and advantages of the present invention have been disclosed in the foregoing description, the disclosure is illustrative only and changes may be made in detail. Other modifications and alterations are within the knowledge of those skilled in the art and are to be included within the scope of the appended claims.

I claim:

1. A multi-element directional antenna comprising:

a conductive ground plane element having a first surface;

a conductive radiating element substantially vertically disposed upon the first surface of the ground plane element, a conductive reflector element substantially vertically disposed upon the first surface of the ground plane element; and a pair of LC traps, each LC trap including a conductive loop element and a conductive resonance element coupled in series manner, said conductive loop element having a first end and a second end, said first end being coupled to an associated one of said radiating element or reflector element, and said second end being coupled to the conductive resonance element.

2. The multi-element directional antenna according to claim 1 having a direction of maximum signal propagation and further comprising:

a director structure disposed away from the radiating element in the direction of maximum signal propagation.

3. The multi-element directional antenna according to claim 1 wherein the ground plane element is substantially planar.

4. The multi-element directional antenna according to claim 1 wherein the reflector element and ground plane element are integrally formed from a conductor sheet.

5. The multi-element directional antenna according to claim 1 wherein the conductive resonance element is a substantially planar element having a predetermined area.

6. A multi-element directional antenna having a direction of maximum propagation, said antenna comprising:

a ground plane element having a first surface;

an active radiating element disposed upon the first surface of the ground plane element;

a parasitic reflector element disposed away from the active radiating element in the opposite direction of maximum propagation; and a pair of LC trap structures, each LC trap structure including a conductive loop element and a conductive resonance element coupled in series manner, said conductive loop element having a pair of opposed ends, one of the ends being coupled to an associated one of said radiating element or parasitic reflector element, and the other of the ends being coupled to conductive resonance element.

7. The multi-element directional antenna according to claim 6 wherein the ground plane element and the radiating element are in substantially perpendicular relationship.

8. The multi-element directional antenna according to claim 6 wherein a width of the radiating element and reflector element are substantially equal.

9. The multi-element directional antenna according to claim 8 wherein the ground plane element includes an aperture through which a dielectric substrate is received.

10. The multi-element directional antenna according to claim 6 wherein the conductive resonance element is a substantially planar element having a predetermined area.

11. A multi-element directional antenna comprising:

a horizontally disposed ground plane element;

an active radiating element vertically disposed upon the ground plane element;

a reflector element vertically disposed upon the ground plane element; and a pair of LC trap structures, each LC trap structure including a conductive loop element and a conductive resonance element coupled in series manner, said conductive loop element having a pair of opposed ends, one of the ends being coupled to an associated one of said radiating element or reflector element, and the other of the ends being coupled to conductive resonance element.

12. The multi-element direction antenna according to claim 11 further comprising:

a director element disposed away from the radiating element and the reflector element.

13. The multi-element directional antenna according to claim 11 wherein the conductive resonance element is a substantially planar element having a predetermined area.

* * * * *